US007542875B2

(12) United States Patent
Rogers

(10) Patent No.: US 7,542,875 B2
(45) Date of Patent: Jun. 2, 2009

(54) RECIPROCATING PUMP PERFORMANCE PREDICTION

(75) Inventor: John Thomas Rogers, Garland, TX (US)

(73) Assignee: Performance Pulsation Control, Inc., Plano, TX (US)

( * ) Notice: Subject to any disclaimer, the term of this patent is extended or adjusted under 35 U.S.C. 154(b) by 195 days.

(21) Appl. No.: 11/384,020

(22) Filed: Mar. 17, 2006

(65) Prior Publication Data

US 2006/0228225 A1 Oct. 12, 2006

Related U.S. Application Data

(60) Provisional application No. 60/662,734, filed on Mar. 17, 2005.

(51) Int. Cl.
*F04B 49/00* (2006.01)

(52) U.S. Cl. ..... 702/183; 702/189; 702/141; 702/104; 700/21; 700/90; 417/63

(58) Field of Classification Search ..... 702/183, 702/188–189, 74, 91, 104, 114; 175/24; 417/43, 63; 700/90, 21
See application file for complete search history.

(56) References Cited

U.S. PATENT DOCUMENTS

| | | | | |
|---|---|---|---|---|
| 6,882,960 | B2 | 4/2005 | Miller | |
| 7,130,751 | B2 | 10/2006 | Kyllingstad | |
| 7,143,007 | B2 | 11/2006 | Long et al. | |
| 2004/0167738 | A1 * | 8/2004 | Miller | 702/114 |
| 2004/0199324 | A1 | 10/2004 | Li et al. | |
| 2005/0276708 | A1 | 12/2005 | Miller | |

FOREIGN PATENT DOCUMENTS

EP 0 092 123 10/1983

OTHER PUBLICATIONS

"Optimum," National Oilwell Varco, 2005, 2 pages.

* cited by examiner

*Primary Examiner*—Drew A Dunn
*Assistant Examiner*—Hien X Vo

(57) ABSTRACT

Performance parameters for a reciprocating pump including pulsation energy, temperature energy, solids, Miller number and chemical energy and the like are monitored and employed to at least periodically compute a total energy number over the operating life of the pump. The current computed value is compared to a predictive failure value empirically determined for the respective pump design, to determine when failure is likely to be imminent. Scheduling of maintenance with other pumping operations and objective rating of competing designs is possible based on the total energy number.

25 Claims, 3 Drawing Sheets

RECIPROCATING PUMP PERFORMANCE PREDICTION

CROSSREFERENCE TO RELATED APPLICATION AND CLAIM OF PRIORITY

The present application is related to U.S. Provisional Patent No. 60/662,734, filed Mar. 17, 2005, entitled "RECIPROCATING PUMP PERFORMANCE PREDICTION". U.S. Provisional Patent No. 60/662,734 is assigned to the assignee of the present application and is hereby incorporated by reference into the present disclosure as if fully set forth herein. The present application hereby claims priority under 35 U.S.C §119(e) to U.S. Provisional Patent No. 60/662,734.

TECHNICAL FIELD OF THE INVENTION

The present invention is directed, in general, to the operation of reciprocating systems and, more specifically, to predicting performance of such reciprocating systems to avoid catastrophic failure.

BACKGROUND OF THE INVENTION

Reciprocating systems (such as reciprocating pump systems) and similar equipment operate in many types of cyclic hydraulic applications. The operating performance K variables of such equipment include, but are not limited to, pressure, fluids, temperature, and the presence and type of solids within the fluid being pumped. Most, if not all, of those variables can have either steady state or dynamic values. In addition, periodic service, remote locations and/or hazardous conditions are other factors that can affect the operating performance and operational life of the pump.

Random failure of critical pump parts create many operational problems, including unplanned downtime, costly unscheduled maintenance and repair, emergency callout of maintenance personnel, and loss of operating revenue. Pumps are not generally monitored due to the insufficient benefits warranting the additional expense. Generally monitoring is only performed as part of troubleshooting or maintenance and not as part of normal operation. Even if such monitoring were to take place, it is likely only to alert the operator that a problem has arisen and cannot currently predict an impending failure.

Operating in less than ideal conditions may result in damage to parts of the system and/or degrade performance. Fluctuations in operation are sometimes extremely short in duration, and may not be captured by conventional recording or acquisition equipment. Moreover, the equipment operator may not always know exactly what specific anomalies or failures have occurred. In addition, irregular or inconsistent maintenance could lead to early failure. Remote locations requiring frequent visits to check operation quality contribute to both the difficulty and the expense of maintaining operation.

From another perspective, many opinions exists about the quality of competing parts, including which are better and provide longer operating life or more trouble-free operation than others. No objective rating system currently exists for critical parts. Likewise, no method of predicting part life currently exists.

There is, therefore, a need in the art for evaluating the operation of hydraulic pulsation systems (such as reciprocating pump systems), predicting future performance and evaluating part life.

SUMMARY OF THE INVENTION

To address the above-discussed deficiencies of the prior art, it is a primary object of the present invention to provide, for use in hydraulic pulsation systems (such as reciprocating pump systems), monitoring of performance parameters including pulsation energy, temperature energy, solids, Miller number and chemical energy and the like for use in at least periodically computing a total energy number over the operating life of the system. The current computed value is compared to a predictive failure value empirically determined for at least one part of the system. This comparison aids in determining when failure is likely to be imminent. Scheduling of maintenance with other system operations and objective rating of competing designs is possible based on the total energy number.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

Before undertaking the DETAILED DESCRIPTION OF THE INVENTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

FIGS. 1 through 5, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged device.

Figure 1:
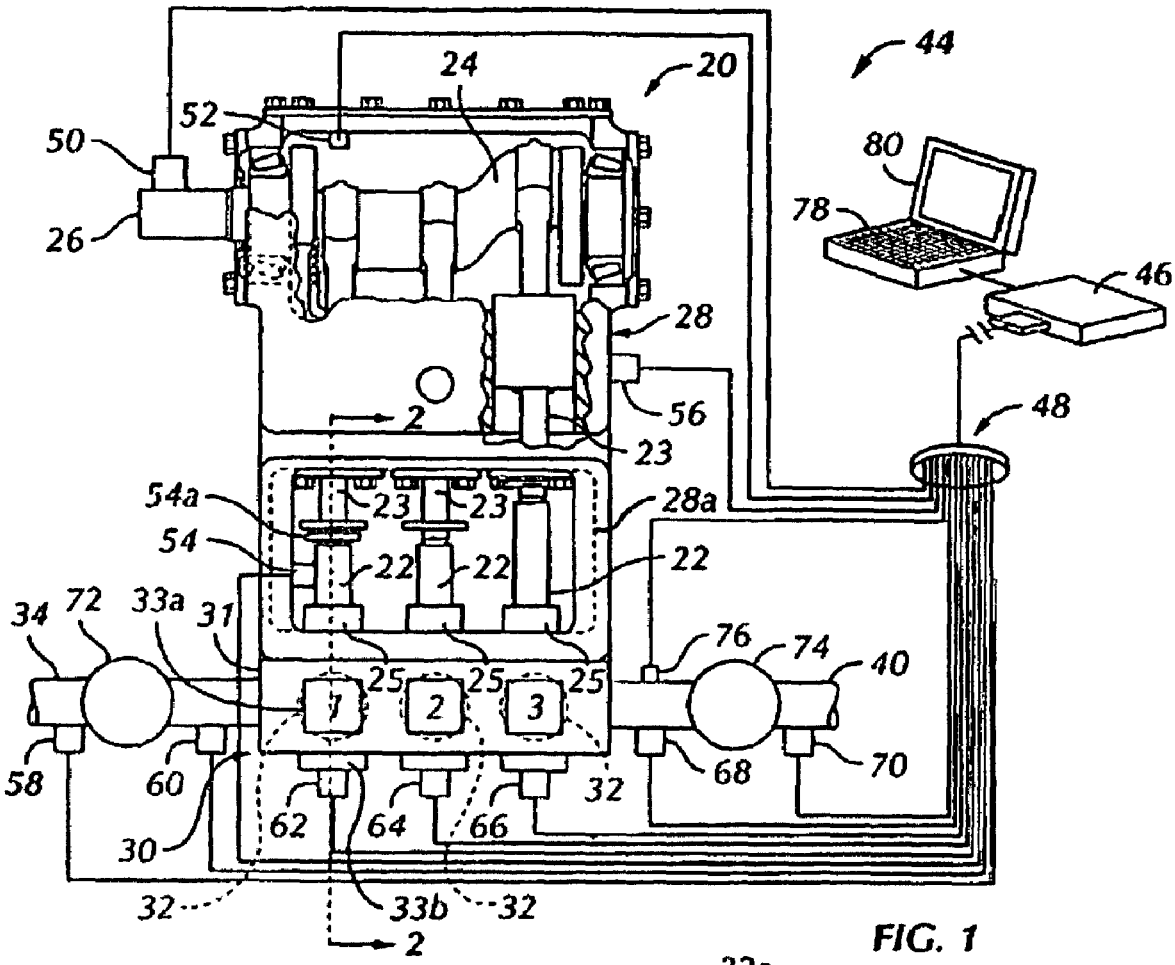
FIG. 1 depicts a top plan and somewhat schematic view of a reciprocating pump with a performance monitoring and prediction system according to an exemplary embodiment of the present disclosure.
Figure 2:
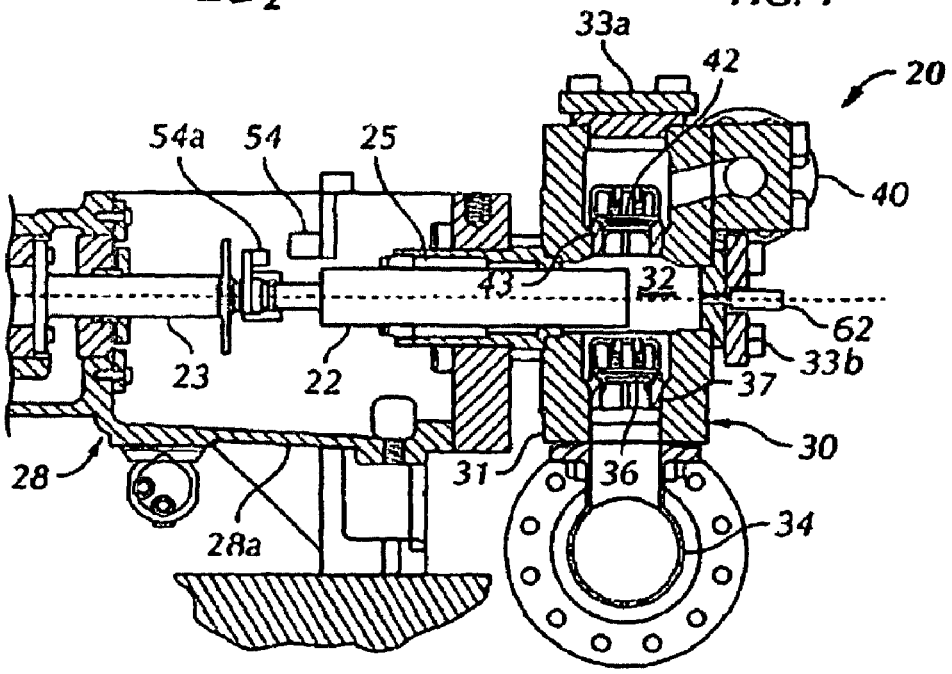
FIG. 2 is a longitudinal central section view taken generally along line 2-2 of FIG. 1.

FIG. 1 depicts a top plan and somewhat schematic view of a reciprocating pump with a performance monitoring and prediction system according to an exemplary embodiment of the present invention, while FIG. 2 is a longitudinal central section view taken generally along line 2-2 of FIG. 1. Pump 20 may be one of a type well-known and commercially available. Preferably, pump 20 is a so-called triplex plunger pump. Pump 20 is configured to reciprocate three spaced apart plungers or pistons 22, each connected by suitable connecting rod and crosshead mechanisms, as shown, to a rotatable crankshaft or eccentric 24. Crankshaft or eccentric 24 includes a rotatable input shaft portion 26 adapted to be operably connected to a suitable prime mover, not shown, such as, for example, an internal combustion engine or electric motor. Crankshaft 24 is mounted in a suitable "power end" housing 28. Power end housing 28 is connected to a fluid end structure 30 configured to have three separate pumping chambers 32. The three separate pumping chambers 32 are exposed to the respective plungers or pistons 22. One such chamber 32 is shown in FIG. 2.

FIG. 2 includes a more scale-like drawing of fluid end 30 of a typical multi-cylinder power pump 20. More specifically, FIG. 2 is taken in cross-section through a typical one of multiple pumping chambers 32. At least one pumping chamber 32 is provided for each plunger or piston 22. Fluid end 30 includes housing 31. Housing 31 has multiple cavities or pumping chambers 32 (only one is shown in FIG. 2). Each pumping chamber 32 receives fluid from inlet manifold 34 by way of a conventional poppet type inlet or suction valve 36 (only one shown).

Piston 22 projects at one end into chamber 32 and is connected to a suitable crosshead mechanism, including crosshead extension member 23. Crosshead extension member 23 is operably connected to crankshaft or eccentric 24 in a known manner. Piston 22 also projects through a conventional packing or piston seal 25. Each piston 22 is preferably configured to chamber 32. Each piston is also operably connected to discharge piping manifold 40 by way of a suitable discharge valve 42, as shown. Valves 36 and 42 are of conventional design and typically spring biased to their respective closed positions. Valve 36 and 42 each also include or are associated with removable valve seat members 37 and 43, respectively. Each of valves 36 and 42 may preferably have a seal member (not shown) formed thereon. The seal member is engageable with the associated valve seat to provide fluid sealing when the valves are in their respective closed and seat engaging positions.

Fluid end 30 shown in FIG. 2 is exemplary and depicts one of three cylinder chambers 32 provided for pump 20. Each cylinder chamber 32 for pump 20 is substantially like the portion of the fluid end 30 illustrated. Those skilled in the art will recognize that the present invention may be utilized with a wide variety of single and multi-cylinder reciprocating piston power pumps as well as possibly other types of positive displacement pumps. However, the system and method of the invention are particularly useful for performance analysis and prediction of reciprocating piston or plunger type pumps. Moreover, the number of cylinders of such pumps may vary substantially between a single cylinder and essentially any number of cylinders or separate pumping chambers, with the illustration of a triplex or three cylinder pump being simply exemplary.

The performance analysis and prediction system of the present disclosure is illustrated and generally designated by the numeral 44 in FIG. 1. System 44 is characterized, in part, by digital signal processor 46 operably connected to a plurality of sensors via suitable conductor means 48. Processor 46 may be a commercially available data processing system and operating software or may be proprietary, and may include wireless remote and other control options associated therewith. Preferably, processor 46 is operable to receive signals from a power input sensor 50. Power input sensor 50 may comprise a torque meter (not shown). The temperature of the power end crankcase oil may be measured by temperature sensor 52.

Additionally, crankshaft and piston position may be measured by a non-intrusive position sensor 54. Position sensor 54 may include a beam interrupter **54*a* mounted on a pump crosshead extension 23. Beat interrupter 54*a* may, for example, interrupt a light beam provided by a suitable light source or optical switch (not shown). Position sensor 54 may be of a type commercially available such as a model EE-SX872 manufactured by Omron Corporation. Preferably, position sensor 54 includes a magnetic base for temporary mounting on part of power end frame member 28*a*. Beam interrupter 54*a* may comprise a flag mounted on a band clamp attachable to crosshead extension 23 or piston 22. Alternatively, other types of position sensors may be mounted so as to detect the position of crankshaft or eccentric 34 in lieu of or in conjunction with position sensor 54**.

Vibration sensor 56 may be mounted on power end 28 or on discharge piping or manifold 40, or on valve covers **33*a* and 33*b*. Vibration sensor 56 preferably senses vibrations generated by pump 20. Suitable pressure sensors 58, 60, 62, 64, 66, 68 and 70 are adapted to sense pressures in various parts of system 44. For example, pressure sensors 58 and 60 preferably sense pressure in inlet piping and manifold 34 both upstream and downstream of pressure pulsation dampener or stabilizer 72 (if such is used in the pump being analyzed). Pressure sensors 62, 64 and 66 sense pressures in the pumping chambers of their respective plungers or pistons 22. For example, as shown in FIG. 2, chamber 32 is associated with pressure sensor 62. Pressure sensors 68 and 70 sense pressures upstream and downstream of a discharge pulsation dampener 74. Still further, fluid temperature sensor 76 may be mounted on discharge manifold or piping 40 to sense the discharge temperature of the working fluid. Although fluid temperature sensor 76 is depicted in a specific location, it should be understood that fluid temperature sensor 76 may in any location along the discharge manifold or piping 40. Fluid temperature may also be sensed at inlet or suction manifold 34. Processor 46** may also receive either automatically or manually additional data from other sources besides a pump, such as but not limited to, other monitoring equipment for pumped fluid properties. It is contemplated some data may be manually inputted.

Pump performance analysis and prediction system 44 may require all or part of the sensors described above, as those skilled in the art will appreciate from the description which follows. Preferably, processor 46 is connected to a terminal or another processor 78 including a display unit or monitor 80. Still further, processor 46 may be connected to a signal transmitting network, such as the Internet, or a local network.

System 44 is adapted to provide a wide array of graphical displays and data associated with the performance of a power pump. For example, system 44 is preferably adapted to display pump performance on a real time or replay basis. Although an exemplary embodiment of the present disclosure monitors several pump features and any associated signals (and, even optionally, alarms), the present disclosure goes beyond simply monitoring for troubleshooting or failure detection. Preferably, the present disclosure correlates the measured values to predict pump performance using data from at least some (but preferably all) components exposed to and affected by cyclic hydraulic pressures. An exemplary embodiment of the present disclosure correlates the measured values into a total energy (TE) or a total energy number (TEN) (herein referred to as TE). TE is preferably based on a mathematical combination of a subset, multiple subsets or all of the measured values correlated by system 44. An exemplary set of parameters relating to pump performance is listed below:

- pulsation energy (Pe)—the continuous measurement of pressure magnitude changes taken by measuring the area of pressure magnitude over cycle time;
- temperature energy (Te);
- solids energy (Se);
- Miller number energy (Me);
- chemical (Ph) energy (Phe);
- rotational energy (Re);
- volume energy (Ve);
- spring energy (Se);
- hydrogen sulfide factor (H2Se);
- barite factor (Be);
- acceleration energies (Ae);
- valve delay factor (VDFe);
- mud base (e.g., oil, water or synthetic) factor (Mde);
- constants associated with each of the above;
- corrosion factor;
- a slurry condition; and
- a general constant (GC).

Although a subset of parameters is listed above, it should be understood that other parameters may also be used or conceived later during practice. Preferably, a specific parameter set is tailored to, for example, a particular pump, pump family, type of pump application, or desired performance evaluation. As noted earlier, one or more subsets of the above-listed parameters are mathematically combined to yield a TE value. TE values may be found by one or more of the following: addition/subtraction, multiplication/division, weighting of individual parameters or parameter groups by constants, etc. The precise mathematical formula for TE will be specific to, for example, the configuration of a given pump, family of the given pump or pump application. Thus, TE should be determined empirically. It should be understood that the precise mathematical formula may also be determined according to the specific performance evaluation desired.

The formula derived and employed for performance of a particular pump creates a TE value resulting from cumulative repetitious inputs, and thus automatically takes into account variable conditions. The value computed preferably allows an operator to predict impending failures by comparing the current value to a value at which failure is expected to occur. Thus, a user has the ability to model an upcoming pump application that, when integrated, predicts critical part life and part consumption. As such, the corresponding models may be used to simulate the system, system part or a selective grouping of the system parts. Monitoring data from multiple existing sources (sensors) within the pump may be integrated into a formula.

Figure 3:
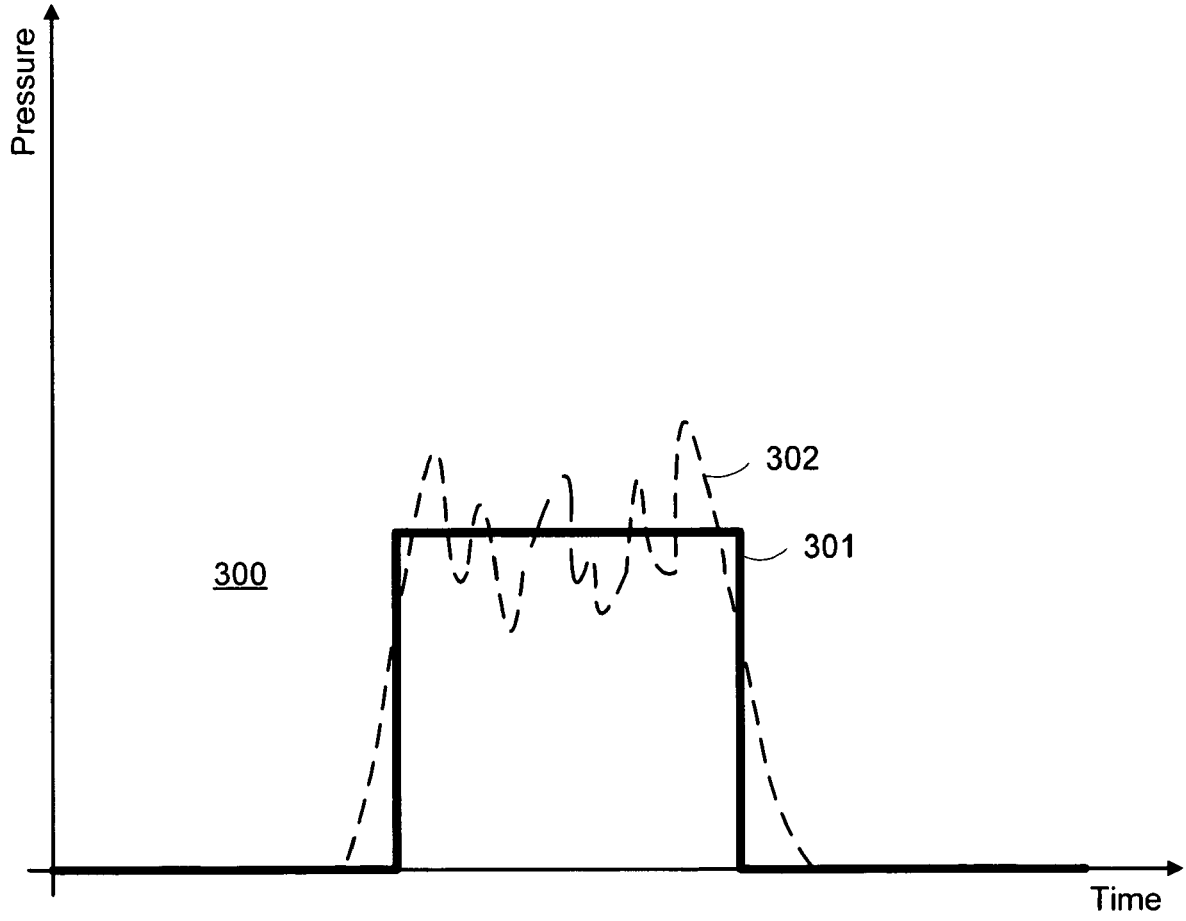
FIG. 3 is an exemplary pressure cycle curve in accordance with an embodiment of the present disclosure.

TE is generally proportional to all selected parameters integrated over time. The pressure cycle curve 300 depicted in FIG. 3 is a plot of the magnitude of pressure exerted by the system (the y-axis) over time (the x-axis). In general, TE may be represented as the area under the pressure cycle curve 300, as seen in FIG. 3. Ideally, the pressure cycle curve 300 is represented by a perfect square wave (depicted by a thick, solid line 301). In practice, however, the one pressure cycle curve 300 is generally some variation of the square wave (such as the curve depicted by a thin, dotted line 302).

Where there are repetitive cycles in a system, such as reciprocating mud pump system 20, the frequency of the pressure cycle curve may change with any change in the system cycle. Similarly, as the system experiences pressure changes, the magnitude of the curve may also change. Each pulse (and specifically the area under each pulse) is thus indicative of the nature of both preceding and post-ceding energy outputs of the system. Similarly, the fatigue cycle of the pressure cycle curve is indicative of the durability of the system. In general, if the magnitude of the curve is minimized, the life or durability of the system is relatively more robust. On the other hand, if the magnitude of the curve is relatively higher than normal, the life or durability of the system is relatively less robust. Thus, the area under the pressure cycle curve, or TE, may be used to monitor system performance over time and predict system durability.

Although only one cycle is depicted in FIG. 3, it should be understood that any number of cycles may be monitored and thus a TE value averaged over these cycles may also be calculated. Moreover, although the description above describes system performance, it should be understood that a pressure cycle curve may be generated on a part by part or sub-system basis.

In addition, use of the TE number creates a basis for fairly and objectively comparing competing parts by creating a rating system. Thus, for critical parts or assemblies, the customer may compare the TE number of one product against the same of another product. Thus, the customer can predict which part is likely to be more durable. By providing an objective quality rating for a particular part or family of parts, sellers of such parts may promote the TE value and thus provide value-added service to their customers. In drilling applications, for example, a drilling rig contractor can now interface with their customer and provide fair and impartial evaluations of critical equipment. The predictive feature of the present invention will reduce the cost of maintaining critical parts by allowing better part purchasing and critical maintenance scheduling. By scheduling maintenance and replacement to coincide with planned downtime, operating delays and associated loss of revenue are avoided. In addition, poor or inadequate maintenance may also be readily identified, eliminated or modified as necessary.

Figure 4:
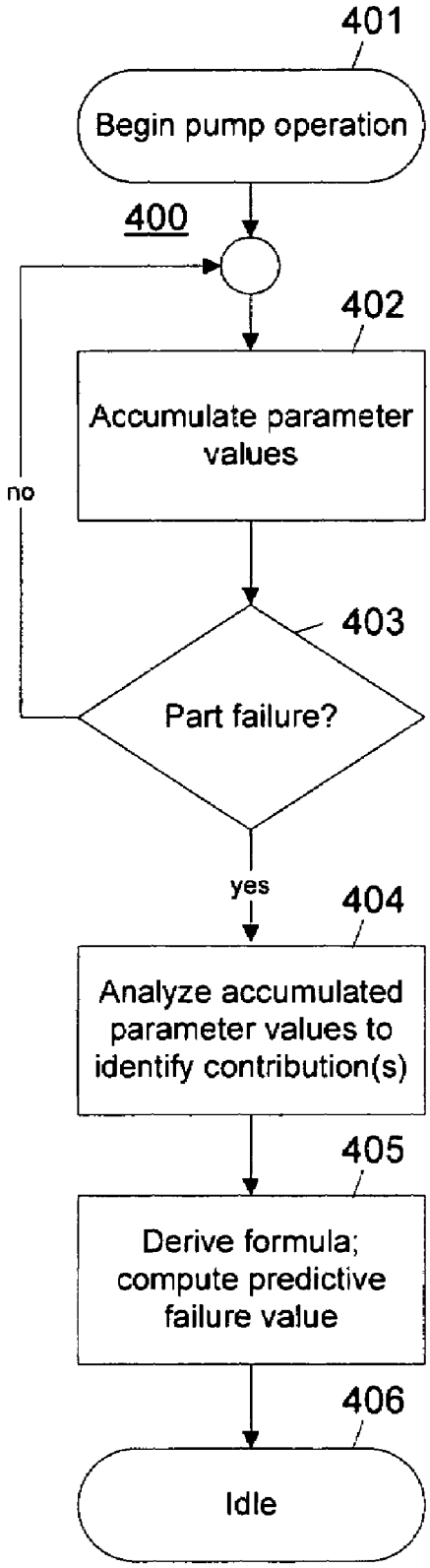
FIG. 4 is a high level flowchart for a process deriving a total energy formula for monitoring and predicting reciprocating pump performance according to an exemplary embodiment of the present disclosure.

FIG. 4 is a high level flowchart for a process of deriving a TE formula for reciprocating pump performance monitoring and prediction according to an exemplary embodiment of the present disclosure. Process 400 begins with initiating operation of a test pump (step 401) in which monitoring of some set of the parameters identified above is enabled. During operation, the values for the selected set of parameters are periodically recorded and are accumulated over time (step 402). Preferably, a monitoring system is concurrently employed to detect pump failure (step 403) in accordance with the known art. As long as the pump remains operational, data continues to be accumulated for use in deriving a TE number for the pump configuration being tested.

Once a pump failure occurs, the accumulated parameter values are analyzed using known analysis methods and other methods that may be contemplated later. The relative contribution(s) of each parameter within the set are monitored (step 404). Curve-fitting algorithms are then employed to derive a formula for the value of the TE number at or above which failure may be reliably predicted as imminent (step 405). The process then becomes idle (step 406) until another pump is tested.

Those skilled in the art will recognize that the process described above may be repeated for a number of pumps having the same design, to provide statistically more accurate information on which to base derivation of the TE formula for that design. In addition, the TE formula derived for a given pump design need not utilize all of the parameters monitored in acquiring the data set, since some of those parameters may have only negligible impact on the potential for failure.

Figure 5:
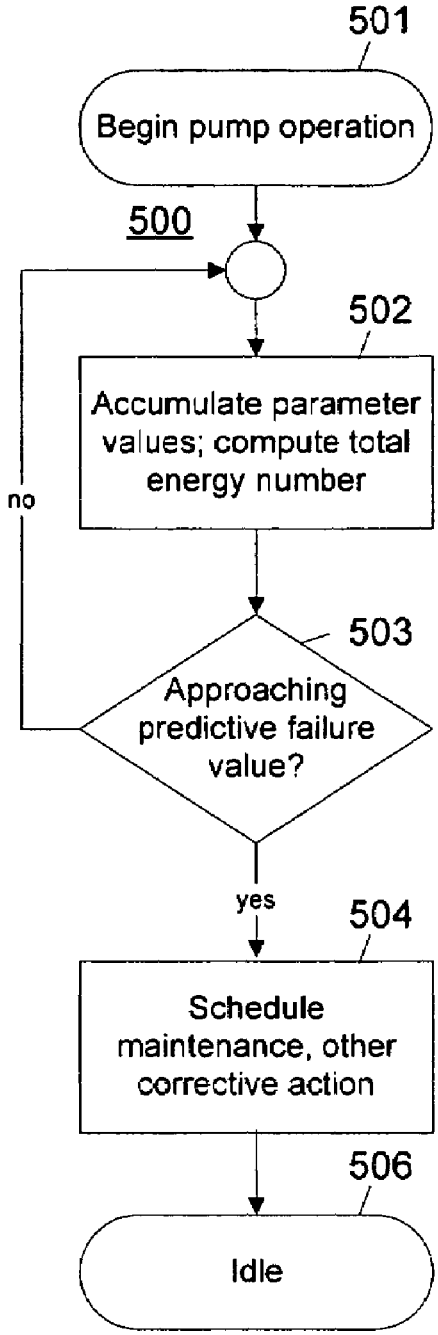
FIG. 5 is a high level flowchart for a process employing a total energy formula for monitoring and predicting reciprocating pump performance according to an exemplary embodiment of the present disclosure.

FIG. 5 is a high level flowchart for a process of employing a TE formula during reciprocating pump performance monitoring and prediction according to one embodiment of the present invention. Process 400 begins with initiation of operation of a pump (step 501) in which at least a set of the parameters identified above are monitored. During operation, the parameter values are accumulated periodically, and at least periodically the TE number for the pump is calculated (step 502) based on all or some of the monitored performance parameters. The computed TE number is then compared to the value of the TE number previously determined to represent the operational point at which failure is predicted to be imminent (step 503). If the current TE number for the pump is not approaching that predictive failure value (within, say, 10%), the pump operation is continued. However, as the TE number gets close to the predictive failure value, maintenance or other corrective action is scheduled (step 504), preferably coordinated with established operations.

A device in accordance with exemplary embodiments of the present disclosure may be used in a variety of applications including, for example, a mud pump valve. A mud pump valve includes a valve body with a seal installed or bonded thereto. Typically, the valve body is a "pancake" section of metal with a lower and upper stem to guide the action of the valve during movement. On the sealing stroke, the valve comes to rest on a separate valve seat with a seal, typically polyurethane, therebetween. Polyurethane, however, will wear to the point where the seal begins to leak, which in turn may lead to damage beyond just the seal. For example, the valve shuts at high loads and high velocity, squeezing any fluid out. A fluid cut or jet cut occurs in the valve's pancake section and/or the area of the seat that experiences the high pressure fluid velocity. If left unattended to for long, the jetting fluid will "cut" (wear) through the metal thickness of the seat, damaging the fluid end module. Repair or replacement of this valve is very expensive due to the valve position. Typically, the valve is seated on a valve deck in the module that, if cut, must be replaced at substantial material costs and downtime.

Currently, preventative action usually involves a person inspecting each fluid end module (three per pump) on each pump (2-4 per drilling rig) once or twice a day, essentially listening for hydraulic leaking sounds. In accordance with an exemplary embodiment of the present disclosure, suppose that a device with a valve sensor and transmitter is employed in a mud pump valve (e.g., a "smart valve"). The device indicates the specific amount of wear in the polyurethane seal and interfaces with the transmitter located in the valve stem and with a sensing device. The valve stem is preferably removable and may be installed into new valves for reuse. The sensing device receives a signal from the thickness sensor and transmits a corresponding signal through the fluid and fluid end module wall. An external monitoring device records the signal from each valve. The acquired data from the "smart valve" is then forwarded to a computer monitoring the system. The computer, in turn analyzing the signals and transmits the appropriate alarms in accordance with an exemplary embodiment of the present disclosure.

Other applications similar to the "smart valve" described above may also be apparent, such as a "smart piston." A mud pump piston is composed of a piston body (sometimes called a hub) with a seal (called a piston rubber or elastomer) installed or bonded thereto. The piston body is a "pancake" section of steel with a forward extension for the seal to be installed over and against both. The seal may be replaceable or bonded. The outer diameter of the pancake section of the piston, along with the outer diameter of the seal, guide the action as the piston reciprocates in a piston liner. On the forward or sealing stroke, the seal is forced against the pancake piston body section and expands radially out against the piston liner to create the seal, which is subject to both sliding friction and sealing pressures. The seal, which may be rubber, rubber with a fabric heel or polyurethane, will wear to the point that a leak arises, which can lead to damage beyond the seal. Because of the high pressure in front of the seal, the seal expands as stated but is subject to high friction during the piston stroking, which creates an additional cause of wear and failure. The heel of the piston seal traps fluid, which jets out during sealing. As the heel of the seal wears, the amount of fluid jetting increases, which increases wear rate and potential for damage. If left unattended to for long this jetting fluid will cut the piston hub outer diameter rendering the hub unsuitable for reuse. It may also fluid cut the piston liner.

Currently, preventative action usually involves a person inspecting each fluid end module (three per pump) on each pump (2-4 per drilling rig) once or twice a day, essentially examining the backside of the piston for a leak. In a "smart piston", according to an exemplary embodiment of the present disclosure, the piston would be fitted with a device to indicate when a predetermined amount of wear has occurred. The device, preferably fitted into the piston seal, interfaces with the transmitter located in the piston body and may be reusable to minimize the ongoing cost to the user. The device further interfaces with a sensing device that picks up the signal corresponding to the wear level and transmits the signal from the back side of the piston to an external device. The external device picks up the signal from each piston in each pump (for example, a typical pump has three pistons). The device then transmits that data to a computer monitoring system that analyzes signals and transmits appropriate alarms.

The present disclosure is applicable to more than just reciprocating pump monitoring, but may be applied to any type of recurring mechanism in which failure occurs due to component fatigue. By predicting imminent failure, the present invention can minimize costs and coordinate maintenance or replacement with other pumping operations. Additional devices for which the present invention may be readily adapted to and employed with include: centrifugal charge pumps and associated parts; multi-phase pumps and associated parts; valves; controls; suction pulsation control devices; discharge pulsation control devices; instrumentation; hoses; certain pipe fittings; top drives and or internal parts effected by pressure; swivels and or internal parts effected by pressure; kelly pipe; and down hole tools and devices and or internal parts effected by pressure. The present invention might also be employed with any other items in contact with high pressure cyclic fluids. Moreover, the present invention may also be used in gas compressors and gas systems that are exposed to cyclic gas pressures.

Although the present invention has been described in detail, those skilled in the art will understand that various changes, substitutions, variations, enhancements, nuances, gradations, lesser forms, alterations, revisions, improvements and knock-offs of the invention disclosed herein may be made without departing from the spirit and scope of the invention in its broadest form.

What is claimed is:

1. A system comprising:

a plurality of sensors each disposed in or proximate to a reciprocating system, wherein each sensor is positioned to monitor at least one parameter related to the reciprocating system's performance over time and to periodically measure values of the corresponding at least one parameter, each of the sensors measuring values of at least one of a plurality of parameters differing from a value measured by any other one of the sensors; and a data processing system configured to periodically receive values for the parameters based upon measurements from the plurality of sensors, combine received values based upon measurements during a single measurement interval by different ones of the plurality of sensors;

aggregate the combined values over a plurality of measurement intervals to compute a total energy number for at least one part of the reciprocating system; and compare a current computed value of the total energy number with a predictive failure value specific to a configuration for the reciprocating system.

2. The system set forth in claim 1, wherein the predictive failure value specific to a configuration for the reciprocating system is a pre-selected predictive failure value representing a total energy number at which failure is predicted to occur.

3. The system set forth in claim 1, wherein each received value relates to one of: pulsation energy, temperature energy, solids energy, Miller number energy, chemical energy, rotational energy, volume energy, spring energy, hydrogen sulfide factor, barite factor, mud base, a corrosion factor, slurry condition and a general constant.

4. The system set forth in claim 3, wherein the aggregated values are based upon a pressure cycle curve.

5. The system set forth in claim 3, wherein the total energy number is determined by the approximate area under a pressure cycle curve for a plurality of pressure cycles.

6. The system set forth in claim 3, wherein each sensor is capable of monitoring the corresponding at least one parameter relating to the system's performance over two or more of the reciprocating system's cycles.

7. The system set forth in claim 6, wherein the total energy number is computed as an aggregated value determined over the two or more of the reciprocating system's cycles.

8. The system set forth in claim 3, wherein the total energy number is computed after the reciprocating system fails for use in selecting a predictive failure value.

9. The system set forth in claim 3, wherein the reciprocating system is a reciprocating pump system.

10. The system set forth in claim 9, wherein each sensor is disposed in or proximate to at least one of: a piston, a piston seal, a valve, a valve seal, a pump crosshead extension, an eccentric and a pump chamber.

11. A method comprising:

monitoring a plurality of parameters relating to the reciprocating system's performance over time with a plurality of sensors;

periodically measuring values for each of the plurality of parameters;

combining values based on measurements during a single measurement interval for different ones of the plurality of parameters;

aggregating combined values over a time interval to compute a total energy number for at least a part of the reciprocating system; and comparing a current computed value of the total energy number with a predictive failure value specific to a configuration for the reciprocating system.

12. The method set forth in claim 11, wherein the predictive failure value specific to a configuration for the reciprocating system is a pre-selected predictive failure value representing a total energy number at which failure is predicted to occur.

13. The method set forth in claim 11, wherein the parameters relating to the reciprocating system's performance are each one of: pulsation energy, temperature energy, solids energy, Miller number energy, chemical energy, rotational energy, volume energy, spring energy, hydrogen sulfide factor, barite factor, mud base, a corrosion factor, slurry condition and a general constant.

14. The method set forth in claim 13 further comprising:

approximating a pressure cycle curve with the aggregated values.

15. The method set forth in claim 13, wherein the total energy number is determined by the area under a pressure cycle curve for a plurality of pressure cycles.

16. The method set forth in claim 13, wherein the aggregated parameter values are graphically displayed.

17. The method set forth in claim 13 further comprising:

monitoring the parameter relating to the system's performance over two or more of the reciprocating system's cycles.

18. The method set forth in claim 17 further comprising:

computing the total energy number as an aggregated value determined over the two or more of the reciprocating system's cycles.

19. The method set forth in claim 13, wherein the total energy number is computed after the reciprocating system fails for use in selecting a predictive failure value.

20. The method set forth in claim 13, wherein the reciprocating system is a reciprocating pump system.

21. The method set forth in claim 20, wherein monitoring at the least one parameter relating to the reciprocating system's performance is accomplished with a sensor disposed in or proximate to at least one of: a piston, a piston seal, a valve, a valve seal, a pump crosshead extension, an eccentric and a pump chamber.

22. A pump failure prediction system comprising:

a pump;

a plurality of sensors disposed in or proximate to the pump and positioned to periodically sample parameter values, wherein the parameter values is at least one of: pulsation energy, temperature energy, solids energy, Miller number energy, chemical energy, rotational energy, volume energy, spring energy, hydrogen sulfide factor, barite factor, mud base, corrosion factor, slurry condition and a general constant; and a data processing system configured to aggregate values based upon the periodically sampled parameter values, to compute a total energy number for the pump and to compare a current computed value of the total energy number with a predictive failure value specific to a configuration for the pump.

23. The pump failure prediction system set forth in claim 22, wherein the data processing system is configured to approximate a pressure cycle curve with the aggregated parameter values.

24. The pump failure prediction system set forth in claim 22, wherein the total energy number is determined by the area under a pressure cycle curve.

25. The pump failure prediction system set forth in claim 22, wherein the total energy number is computed after the pump fails for use in selecting a predictive failure value.

* * * * *

UNITED STATES PATENT AND TRADEMARK OFFICE

CERTIFICATE OF CORRECTION

PATENT NO. : 7,542,875 B2
APPLICATION NO. : 11/384020
DATED : June 2, 2009
INVENTOR(S) : John Thomas Rogers It is certified that error appears in the above-identified patent and that said Letters Patent is hereby corrected as shown below:

Column 1, line 27, after "performance" delete "K".

Signed and Sealed this

Eighth Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,542,875 B2
APPLICATION NO. : 11/384020
DATED : June 2, 2009
INVENTOR(S) : John Thomas Rogers It is certified that error appears in the above-identified patent and that said Letters Patent is hereby corrected as shown below:

On the title page item (73) Please delete in its entirety: "(73) Assignee: Performance Pulsation Control, Inc., Plano, TX (US)"

Signed and Sealed this
Fifth Day of July, 2011

David J. Kappos

David J. Kappos
*Director of the United States Patent and Trademark Office*